US005397039A

United States Patent [19]

Parcelles

[11] Patent Number: 5,397,039

[45] Date of Patent: Mar. 14, 1995

[54] BABY BOTTLE HOLDER

[76] Inventor: Susan Parcelles, 600 Lewis Ct., Marco Island, Fla. 33937

[21] Appl. No.: 142,683

[22] Filed: Oct. 26, 1993

[51] Int. Cl.[6] ..... A45F 5/00

[52] U.S. Cl. ..... 224/148; 224/901; 224/219

[58] Field of Search ..... 224/148, 901, 219

[56] References Cited

U.S. PATENT DOCUMENTS

| | | | |
|---|---|---|---|
| D. 310,942 | 10/1990 | Woodall | 224/148 |
| 2,494,632 | 1/1950 | Rodin | 224/148 |
| 2,617,105 | 11/1952 | Backman | 224/148 |
| 2,924,413 | 2/1960 | Mahoney | 224/148 |
| 3,065,944 | 11/1962 | Liebendorfer | 224/148 |
| 3,326,430 | 6/1967 | Banks | 224/257 |
| 4,197,890 | 4/1980 | Simko | 224/148 |
| 4,401,245 | 8/1983 | Zills | 224/148 |
| 4,564,957 | 1/1986 | Scharf | 224/148 |
| 4,802,602 | 2/1989 | Evans et al. | 224/148 |
| 4,871,597 | 10/1989 | Hobson | 224/148 |
| 4,974,761 | 12/1990 | Lugue | 224/148 |
| 5,048,734 | 9/1991 | Long | 224/148 |

*Primary Examiner*—Henry J. Recla
*Assistant Examiner*—Gregory M. Vidovich
*Attorney, Agent, or Firm*—Malloy & Malloy

[57] ABSTRACT

A baby bottle holder including a pouch formed of flexible, preferably washable material wherein the bottle extends into the hollow interior of the pouch and is removably maintained therein through the existence of a gripping portion formed on the pouch in somewhat surrounding relation to the baby bottle. An elongated connector strap which also may be elastic has one end affixed to the pouch and an opposite end including an attachment member designed to be removably secured to some type of supporting object such as but not limited to a baby chair, stroller, attendant person, etc.

18 Claims, 1 Drawing Sheet

BABY BOTTLE HOLDER

BACKGROUND OF THE INVENTION

1. Field of the Invention

This invention relates to a device to hold a baby bottle so that it will be prevented from falling onto the ground and/or becoming lost if inadvertently dropped by the baby or infant utilizing the bottle.

2. Description of the Related Art

In utilizing baby bottles, it is a common occurrence for the baby or infant to drop the bottle during use. The bottle almost always comes in contact, due to gravity, with the floor or other surface. Because of such contact with the floor or ground, the nipple portion, which enters the baby's mouth, frequently becomes soiled and therefore presents the possibility of passing germs as well as actual debris, trash, etc. directly to the baby's mouth. It is assumed that various techniques and/or mechanisms exist which attempt to prevent the dropping or inadvertent removal of the baby bottle from the possession of the baby or infant using the bottle. However, even when such devices are utilized, the problem still exists as to the practicality of using such devices and/or their efficient operation in preventing the bottle from actually coming in contact with a soiled surface such as the ground, floor, etc.

There is therefore a recognized need for a device which will prevent contact of the baby bottle, and particularly the nipple portion from coming in contact with the soiled surface. This is best accomplished, through structural details and performance of the present invention, as will be explained in greater detail hereinafter, by efficiently connecting or attaching the bottle to some type of supporting object. Such supporting object may of course vary between a chair, stroller, car seat, shopping cart, crib, purse strap or the body of the attendant of the baby.

In any event, if the baby bottle within the pouch of a preferred embodiment of the invention should fall from the grasp of the baby or infant, the gripping means and attachment cord should be such as to prevent inadvertent slippage or removal of the baby bottle from the interior of the pouch and contact of the bottle with the ground. This again accomplishes cleanliness of the bottle and prevents inadvertent soiling of the nipple portion thereof and the transfer of germs and/or dirt directly to the baby's mouth.

SUMMARY OF THE INVENTION

The present invention relates to a baby bottle holder assembly of the type which facilitates placement and positioning of the baby bottle within the mouth of the baby, when a liquid or food is being extracted therefrom and also facilitates the holding of the baby bottle by the baby or infant providing the baby or infant is old enough to grasp the pouch and/or certain portions thereof.

The pouch includes a hollow interior having a somewhat elongated configuration and having a closed end and an oppositely disposed open end. The overall size of the pouch is such as to allow removable positioning therein of two conventionally-sized baby bottles, namely a five ounce size and/or an eight ounce size. In order to ensure that the bottle will not become inadvertently removed from the hollow interior of the pouch, a gripping means is provided. This gripping means is in the form preferably of an elastic material portion or band mounted on or within a portion of the pouch and disposed in surrounding relation to the bottle and in gripping engagement therewith when the bottle is in an operative position within the pouch. The size and overall configuration of the elastic gripping band is to allow removal of the baby bottle from the interior of the pouch when such is desired. However, the strength of the elastic gripping band should be such as to eliminate the easy, inadvertent removal of the baby bottle from the interior of the pouch. A flange extends upwardly from the gripping band to the open end. Such flange may be of flexible and/or absorbent material and has a substantially annular configuration. The flexible material flange allows the infant or baby to actually grip the pouch while the baby bottle is mounted therein and thereby facilitating placement or maintenance of the nipple portion of the baby bottle within the baby or infant's mouth. As indicated, the flange may be made of absorbent material so as to absorb any drippage or leakage from the mouth or nipple portion of the baby bottle.

The subject baby bottle holder assembly further includes a connecting means in the form of an elongated elastic material strap having one innermost end fixed to the pouch adjacent to an uppermost end thereof immediately adjacent or contiguous to the periphery of the open end. The opposite end of the elongated connecting strap includes an attachment means. This attachment means may be in the form of an elongated portion which may be doubled back upon itself and having its free end connected to an inner end of the attachment loop so as to form a loop which may be closed or opened and being of sufficient length to surround a supporting object of the type set forth above.

The cooperative position and structure of the connecting strap and the attachment loop is such as to allow attachment of the pouch when it has a baby bottle therein to the aforementioned supporting object. Further, the elongated connecting strap may be formed of elastic material so as to provide some type of shock absorbent feature when in fact the baby bottle and pouch is dropped inadvertently from the baby's grasp. If such elastic feature did not exist, there would be more strain on the various components comprising the subject baby bottle holder assembly. Also, the baby bottle within the pouch should not have a tendency to ricochet back from the end of the length of the connecting strap into possible engagement with the baby. The length of the strap should be sufficient to allow free use of and access to the bottle within the pouch when the baby or infant is consuming the liquid or food therein. However, the length should also be short enough that the baby bottle does not inadvertently land on the ground. Placement of the inner end of the connecting strap adjacent or contiguous to the periphery of the open end facilitates maintenance of the bottle within the hollow interior of the pouch such that it will not become inadvertently dislodged but remain in a somewhat upright orientation when the baby bottle within the pouch reaches the full extent of the connecting strap.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
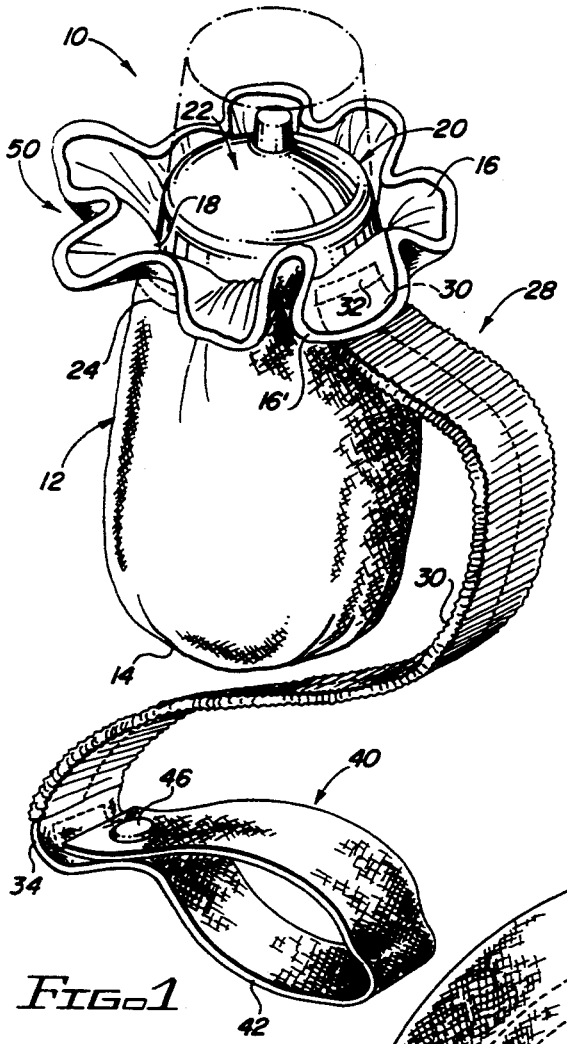
FIG. 1 is a perspective view of the baby bottle holder assembly with a baby bottle therein in an operative position.

As shown in the accompanying figures, the baby bottle holder assembly of the present invention is generally indicated as 10 and includes pouch 12 having a closed end 14 and an open end generally indicated as 16. The pouch 12 has a hollow interior 18 as shown in FIG. 2 and a somewhat elongated configuration so as to allow maintenance and receipt therein of various sizes of baby bottles generally indicated in FIG. 1 as 20. The baby bottle 20 is intended to be positioned in what may be referred to as an operative position. Such operative position is defined by a major portion of the length of the baby bottle being disposed within the hollow interior 18 of the pouch 12 such that the closed end of the baby bottle is in resting engagement with the inner surface of the closed end 14 of the pouch 12. In such operative position, an access end, generally indicated as 22, of the baby bottle 20 protrudes outwardly from the open end 16 so as to provide access to the baby or infant for obvious reasons.

The pouch 12 includes a gripping means generally indicated as 24. This gripping means is preferably in the form of an elastic material band disposed in surrounding relation to the pouch and mounted thereon. The overall configuration and dimension of the gripping band 24 is such as to provide a snug contracting engagement about the bottle 20 when it is in its operative position within the interior of the pouch 12. The strength of the elastic from which the elastic gripping band 24 is formed should be such as to snugly maintain the bottle 20 therein even when the pouch is inadvertently put into an inverted position.

The assembly 10 further includes a connecting means generally indicated as 28. This connecting means is in the form an elongated strap 30 preferably made of elastic and having an innermost end as at 32 connected generally adjacent or immediately contiguous to an outer periphery as at 16' of the open end 16. The opposite or outermost end as at 34 is secured to an attachment means generally indicated as 40.

Figure 3:
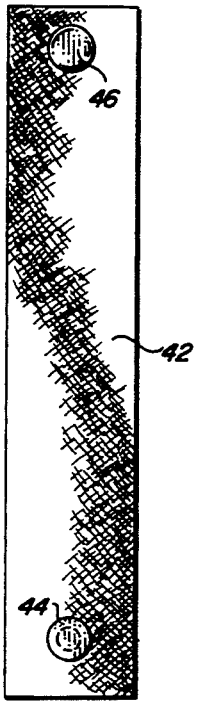
FIG. 3 is a front view of one component of the subject assembly.
Figure 4:
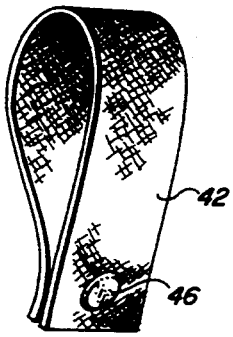
FIG. 4 is a perspective view of the component shown in the embodiment of FIG. 3 in a closed position.
Figure 2:
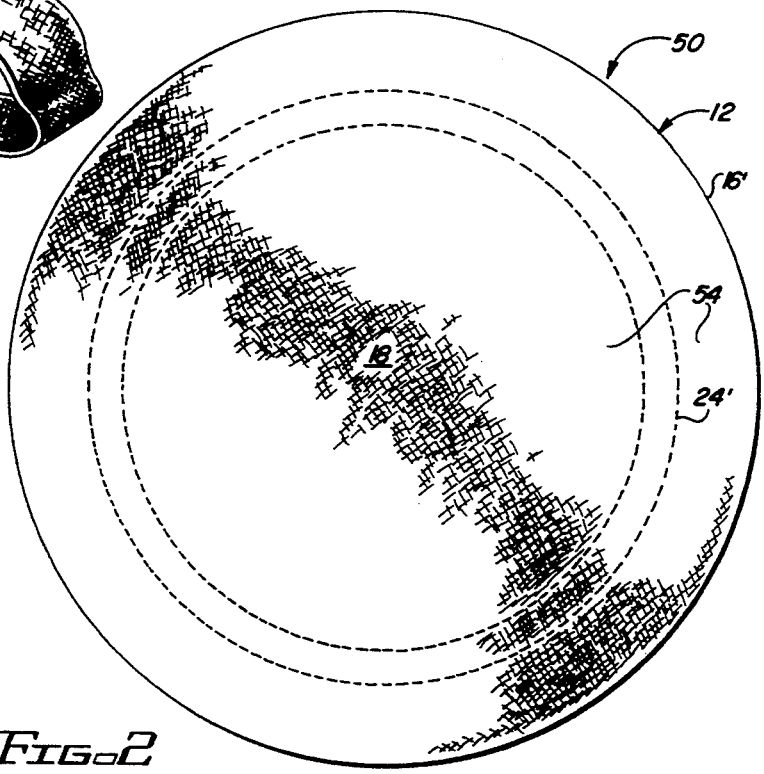
FIG. 2 is a top view of the embodiment of FIG. 1 with the baby bottle absent from the interior of the assembly.

As shown in FIGS. 1, 3 and 4, the attachment means 40 includes an elongated member 42 having a connector-type element as at 44, 46 connected to opposite ends thereof. The connector 44, 46 is such as to be connected to itself thereby forming the elongated attachment member 42 into a loop-type configuration as best shown in FIG. 4. The connector 44, 46 may also be attached or detached with relative ease, but such attachment should have enough strength to allow the elongated member 42 to be encircled and surround some type of supporting object of the type set forth above.

The difference between the positions in FIGS. 3 and 4 show the attachment member 42 in an open position and a closed position respectively.

It should be apparent that other forms of connectors can be used other than a snap-type and/or velcro-type of connector which may be common. As examples, a button or a buckle may be commonly known as other forms of connectors. In any event, safety should be a factor since any dislodgement or inadvertent detachment of such a connector from the attachment means 40 could possibly result in a safety hazard to the baby such as when the baby attempts to swallow such articles.

Another feature of the present invention is the existence of a flexible material flange. Such flange is generally indicated as at 50 and extends from the gripping means and/or gripping band 24' upwardly to the outer periphery 16' of the open end 16 of the pouch 12. This flange may in fact flare outwardly and has a substantially annular configuration. The flange may also be formed of a flexible, washable and/or absorbent material. The flange is provided to add not only to the decorative appearance of the overall assembly but also by being secured to and extending from the gripping means, to serve the functional purpose of allowing the baby or infant to effectively grip the pouch while the baby bottle 20 is maintained in its operative position therein. This aids the baby in maintaining possession of the baby bottle since frequently a baby or infant's hands are not large enough or strong enough to hold the baby bottle itself.

Finally, the interior 18 of the pouch may include a lining as at 54 which may be formed of an absorbent material to aid in the absorbing of any condensation from the outside of the bottle and/or leakage or spillage coming from the mouth of the baby or the access end 22 thereof. Also, the liner 54 may be formed somewhat of an insulative material to allow maintenance of the intended temperature of the contents of the baby bottle 20 when such is desired.

Now that the invention has been described,

What is claimed is:

1. A holder assembly for a baby bottle, said assembly comprising:

a) a pouch including a closed end and an open end oppositely disposed to said closed end, b) said pouch including a hollow interior dimensioned and configured to receive a portion of the baby bottle in an operative position within said hollow interior, c) gripping means formed at least in part of elastic material mounted on said pouch between said open end and said closed end and structured for removably gripping the baby bottle between opposite ends thereof, d) connecting means comprising an elastic strap configuration having a first end secured to said pouch adjacent said open end, said connecting means extending outwardly from said pouch and having a second end with attachment means thereon adapted for removably connecting said connecting means to a supporting object.

2. The assembly as in claim 1 wherein said gripping means comprises an elongated configuration disposed in surrounding relation to the baby bottle when in the operative position and extending transversely to the length of the pouch.

3. The assembly as in claim 2 wherein said elongated configuration further comprises an elongated band formed of elastic material and mounted on said pouch in spaced relation to said open end in closer proximity thereto than said closed end.

4. The assembly as in claim 3 further comprising a flange portion having an annular configuration and secured to and extending from said gripping means to said open end.

5. The assembly as in claim 4 wherein said flange portion is formed of a flexible material along its length and is dimensioned to facilitate gripping by a user of the baby bottle.

6. The assembly as in claim 5 wherein said flange portion is formed of a washable, liquid absorbent material.

7. The assembly as in claim 4 wherein said connecting means is secured to said pouch at a location on said flange in spaced relation to said gripping means.

8. The assembly as in claim 7 wherein said flange portion comprises an outer peripheral edge defining an outer periphery of said open end, said connecting means comprising said elongated strap wherein said first end is secured to said flange portion adjacent said open end.

9. The assembly as in claim 8 wherein said attachment means comprises a loop and connector structure cooperatively adapted to be removably attached in surrounding relation to the supporting object.

10. The assembly as in claim 1 wherein said attachment means comprises a loop and connector structure cooperatively adapted to be removably attached in surrounding relation to the supporting object.

11. The assembly as in claim 1 further comprising a liner defining an interior surface of said hollow interior.

12. The assembly as in claim 11 wherein said liner is formed of an absorbent material.

13. The assembly as in claim 12 wherein said liner is formed of an insulative material.

14. The assembly as in claim 1 wherein said operative position is defined by the baby bottle having a closed end thereof adapted to be disposed within said pouch adjacent said closed end of said pouch and the baby bottle having an access end protruding through said open end of said pouch in an exteriorly accessible location relative to said hollow interior.

15. A holder assembly for a baby bottle, said assembly comprising:

a) a pouch including a closed end and an open end oppositely disposed to said closed end, b) said pouch including a hollow interior dimensioned and configured to receive a portion of the baby bottle in an operative position within said hollow interior, c) gripping means formed at least in part of elastic material mounted on said pouch and structured for removably gripping the baby bottle between opposite ends thereof, said gripping means comprising an elongated configuration disposed in surrounding relation to the baby bottle when in the operative position and extending transversely to the length of said pouch, d) connecting means comprising an elastic strap configuration, said connecting means having a first end being operably connected to said pouch adjacent said open end, said connecting means extending outwardly from said pouch having a second end with attachment means thereon and structured for removably connecting said connecting means to a supporting object, and e) a flange portion secured to and extending from said gripping means, said flange portion having an annular configuration and being structured and dimensioned to facilitate gripping by a user of the baby bottle.

16. The assembly as in claim 15 wherein said gripping means further comprises an elongated band formed of elastic material and mounted on said pouch between said closed end and said open end of said pouch, said elongated band being disposed in spaced relation to said open end and in closer proximity thereto than said closed end.

17. The assembly as in claim 15 further comprising a liner defining an interior surface of said flange portion, said liner being formed of an absorbent material.

18. The assembly as in claim 17 wherein said liner is formed of an insulative material.

* * * * *